US005632601A

United States Patent [19]

Bodmer et al.

[11] Patent Number: 5,632,601

[45] Date of Patent: May 27, 1997

[54] COMPRESSOR

[75] Inventors: Urs Bodmer, Ennetbaden; Patrick Hain, Baden; Vishal Mallick, Birmenstorf, all of Switzerland

[73] Assignee: ABB Research Ltd., Zurich, Switzerland

[21] Appl. No.: 615,884

[22] Filed: Mar. 14, 1996

[30] Foreign Application Priority Data

Apr. 10, 1995 [DE] Germany ..... 195 13 508.3

[51] Int. Cl.[6] ..... F01D 5/14

[52] U.S. Cl. ..... 416/223 B; 416/213 R; 416/204 R

[58] Field of Search ..... 415/200; 416/230, 416/223 R, 223 B, 204 R, 219 R, 219 A, 213 R

[56] References Cited

U.S. PATENT DOCUMENTS

| | | | |
|---|---|---|---|
| 1,535,417 | 4/1925 | Huff | 416/219 |
| 2,848,190 | 8/1958 | Barr | 416/219 R |
| 2,848,192 | 8/1958 | Hayes | 416/219 |
| 4,172,690 | 10/1979 | Kunts | 415/200 |
| 4,260,327 | 4/1981 | Armor et al. | 415/200 |
| 5,431,536 | 7/1995 | By et al. | 415/200 |
| 5,464,325 | 11/1995 | Albring et al. | 416/219 R |

FOREIGN PATENT DOCUMENTS

| | | |
|---|---|---|
| 0593797A1 | 4/1994 | European Pat. Off. . |
| 675279A5 | 9/1990 | Switzerland . |

*Primary Examiner*—John T. Kwon

*Attorney, Agent, or Firm*—Burns, Doane, Swecker & Mathis, L.L.P.

[57] ABSTRACT

This compressor is provided with a compressor impeller (1) which has a hub (2) of plastic fitted with moving blades (5), with a shaft which is connected to the hub (2) and extends along an axis (4), and with a housing which surrounds the compressor impeller (1).

It is intended to provide a compressor which has a compressor impeller produced from a plastic and is nevertheless suitable for comparatively high operating temperatures. This is achieved by the hub (2) of the compressor impeller (1) being produced from a thermoplastic reinforced with continuous fibers, and by the moving blades (5, 20) being prefabricated separately from a thermoplastic reinforced with continuous fibers and connected with a form fit to the hub (2).

10 Claims, 5 Drawing Sheets

COMPRESSOR

FIELD OF THE INVENTION

The invention proceeds from a compressor for gaseous fluids.

The Specification EP 0 593 797 A1 discloses a compressor which is intended for the compression of a gaseous medium. The compressor has a compressor impeller with formed-on moving blades, which are provided with a casing on the side on which the gaseous medium enters. The casing is connected to the ends of all the moving blades. The casing does not extend over the entire length of the moving blades. In the region in which the moving blades are mechanically loaded the most there is not provided any casing which could prevent vibrations of the same or at least dampen them to a certain extent.

The Patent Specification CH 675 279 discloses a compressor impeller for a compressor, which impeller is produced from a metal and its moving blades are formed on in one piece to the hub of the compressor impeller. Such a compressor impeller is generally worked from a solid piece using complex machining processes. This compressor impeller has a comparatively large mass, requiring comparatively considerable energy to be expended to drive it.

Furthermore, compressors which have compressor impellers injection-molded from plastic in one piece are known. These compressor impellers are sometimes provided with a fiber reinforcement, although the previously customary production processes allow only a reinforcement with so-called chopped fibers. Compressor impellers of such a design can be used only for circumferential speeds up to a maximum of 400 m/sec and for operating temperatures up to a maximum of 200° C., since the reinforcement with chopped fibers does not allow higher loads.

SUMMARY OF THE INVENTION

Accordingly, one object of the invention, as defined in the independent claims, is to provide a novel compressor which has a compressor impeller produced from a plastic and which is nevertheless suitable for comparatively high operating temperatures.

To be regarded as the advantages achieved by the invention are that the operating temperature and the rotational speed of the compressor, and consequently its efficiency, are significantly increased in comparison with compressors which are equipped with conventional compressor impellers of plastic. Operating temperatures up to about 280° C. and circumferential speeds of 660 m/sec are now possible.

The compressor impeller has a smaller mass and can be assembled comparatively simply from different individual parts. In the case of a particularly preferred embodiment of the impeller, a prefabricated, carbon fiber reinforced thermoplastic strip is used for producing the hub. In the case of this thermoplastic strip, the orientation of the reinforcing continuous fibers is always optimally ensured, with the result that comparatively good strength of the hub is ensured even at these comparatively high operating temperatures and circumferential speeds. Thanks to the comparatively low mass of the compressor impeller, it also has a small moment of inertia, with the result that the compressor reaches the required operating speed in an advantageously short time during starting and consequently becomes fully effective very quickly.

The further refinements of the invention are described in detail below.

BRIEF DESCRIPTION OF THE DRAWINGS

A more complete appreciation of the invention, its development and many of the attendant advantages thereof will be readily obtained as the same becomes better understood by reference to the following detailed description when considered in connection with the accompanying drawings, which represent only one possible way of implementing the invention, wherein.

DESCRIPTION OF THE PREFERRED EMBODIMENTS

Figure 1:
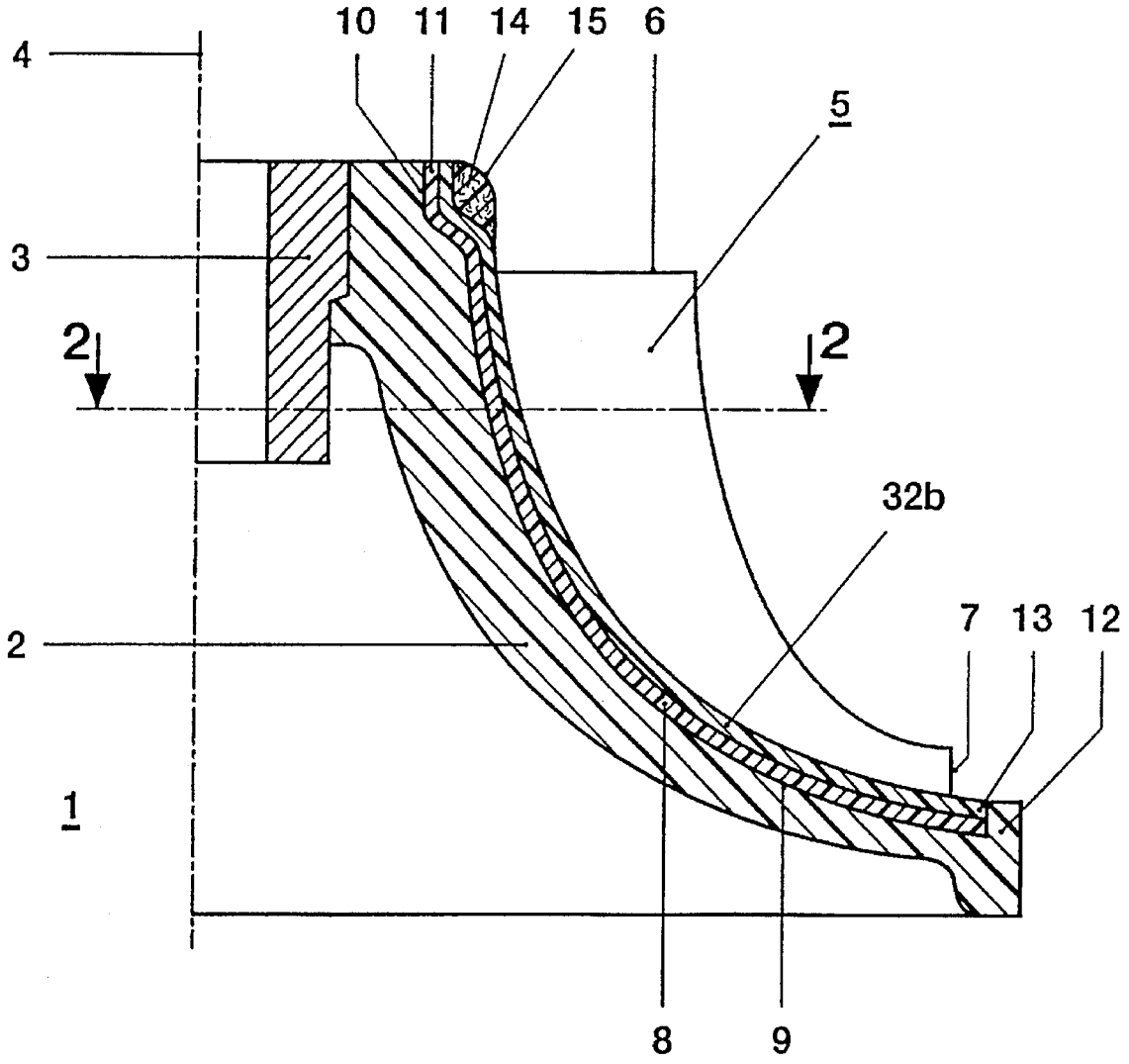
FIG. 1 shows a first partial section through a compressor with a first embodiment of a compressor impeller.

Referring now to the drawings, wherein like reference numerals designate identical or corresponding parts throughout the several views and all elements not required for a direct understanding of the invention have been omitted, in FIG. 1 there is shown a schematically represented partial section through a compressor impeller 1, which is intended for the compression of a gaseous fluid. The compressor impeller 1 has a hub 2, which is produced from a plastic, preferably from a thermoplastic material reinforced with continuous fibers. The hub 2 is fastened on a sleeve 3 produced from metal, and is secured against twisting and against axial slipping. The hub 2 and the sleeve 3 have a common axis 4, which represents the axis of rotation of the compressor impeller 1. The sleeve 3 has a central bore, which is provided for receiving and fastening the shaft (not shown) of the compressor impeller 1. Fastened on the side of the hub 2 remote from the axis 4 are moving blades 5. Provided between the moving blades 5 and the compressor housing, which encloses the compressor impeller 1 but is not shown, are undesignated flow ducts, into which the gaseous medium flows and in which it is accelerated in a known manner and thereby compressed.

The hub 2 was wound from a prefabricated plastic strip reinforced with continuous fibers. Suitable in particular as plastic in this case are temperature-resistant thermoplastics, and carbon fibers are used for the reinforcement.

The hub 2 was wound on a fixture corresponding to the inner contour of the hub 2 such that the carbon fibers are arranged in the circumferential direction, which results in a particularly high strength of the hub 2 in this direction, whereby comparatively high rotational speeds of the compressor impeller 1 and consequently comparatively great efficiencies of the compressor become possible. During the winding, the thermoplastic material of the strip was briefly heated and fused with the layer of strip respectively applied previously. A laser is particularly suitable for this selected and measured brief heating. Such thermoplastic winding processes using lasers as the energy source are known. After completion of the winding operation, the hub 2 thus prefabricated was removed from the fixture and machined to its final definitive state. In particular, the opening for receiving the sleeve 3 had to be machined and, moreover, the outer surface of the hub 2 had to be smoothed in order to be able to use it as a bearing and bonding surface for the fastening of the prefabricated moving blades 5.

Figure 4:
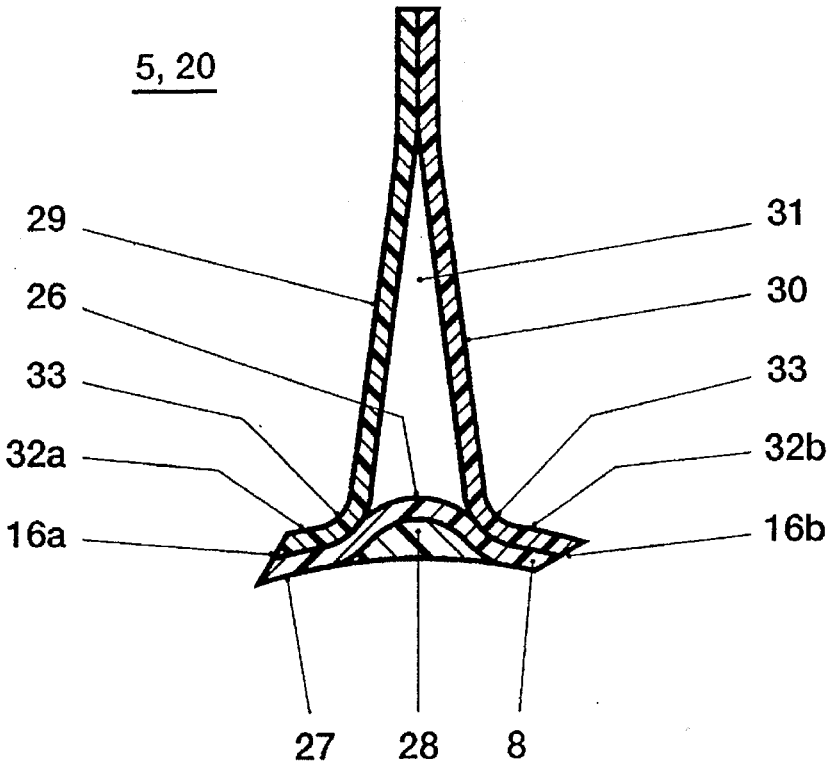
FIG. 4 shows a partial section through a first embodiment of a moving blade of a compressor impeller.
Figure 5:
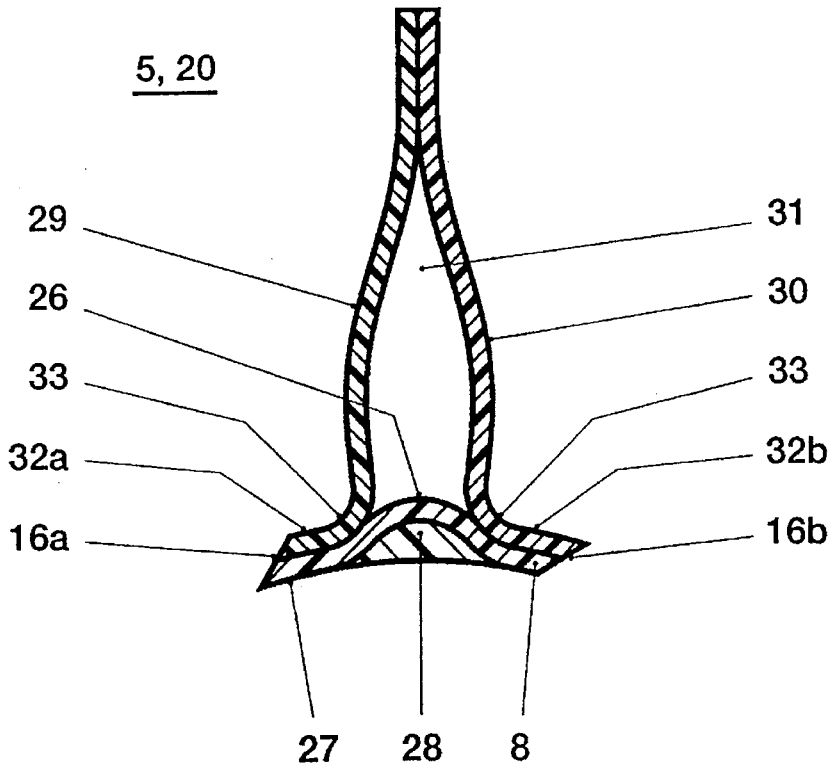
FIG. 5 shows a partial section through a second embodiment of a moving blade of a compressor impeller.

The moving blades 5 have in each case an aerodynamically designed entry edge 6, which lies on the entry side of the gaseous medium into the flow duct of the compressor. On the other side of the flow duct, downstream with respect to the flow of the gaseous medium, there lies in each case the exit edge 7 of the moving blades 5. The moving blades 5 are assembled from a plurality of prefabricated parts, likewise reinforced with continuous fibers, as is schematically represented in FIGS. 4 and 5. These figures are discussed in more detail below. The moving blades 5 each have as a base a base plate 8. The side of the base plate 8 toward the surface 9 of the hub 2 is adapted so precisely to this surface 9 that this base plate 8 rests with a form fit on the surface 9. The surface 9 has on the entry side of the compressor impeller 1 an offset 10, on which the entry-side end piece 11 of the base plate 8 likewise rests with a form fit.

FIG. 4 shows a partial section through a first embodiment of one of the moving blades 5 of the compressor impeller 1. The moving blades 5 are aerodynamically designed in a known manner; the corresponding spherical curvature of the moving blades is not shown in the drawing, for the sake of better overall clarity. The base of the moving blades 5 is formed by the preshaped, uniformly thick base plate 8. The base plate 8 is provided with a bead 26, which protrudes into the interior of the moving blade 5 and extends in the direction of the longitudinal axis of the moving blade 5, said bead being increasingly less pronounced in the downstream direction. The base plate 8 has an underside 27 which is fully matched to the surface 9 of the hub 2. The depression occurring in the underside 27 as a consequence of the bead 26 is filled by means of an epoxy resin filling 28 such that, in this region of the base plate 8 as well, there is a surface fully matched to the surface 9 of the hub 2. The bead 26 is provided with uniformly rounded flanks. The moving blade is formed by two side walls 29 and 30. The side walls 29 and 30 are produced from uniformly thick plastic sheets which are reinforced with continuous fibers and enclose a cavity 31 which narrows in the radial direction. To achieve better vibration damping, this cavity 31 may be foam-filled. The cavity 31 is closed in the region of the entry edge 6 of the moving blade 5 by means of an aerodynamically designed covering (not shown).

The sides walls 29 and 30 are preshaped. They are adhesively attached to the base plate 8 or welded to the latter in an assembly fixture. At the same time, the side walls 29 and 30 are adhesively bonded together or welded over their surface area in the region of the tip of the moving blades 5. The sides walls 29 and 30 are designed such that they respectively have a base part 32*a*, 32*b*, which fits with a form fit onto the surface of the base plate 8 and merges with a radius 33 into the approximately radially running portion of the respective side wall. The base part 32*a* is assigned to the side wall 29 and the base part 32*b* is assigned to the side wall 30. Formed on the upstream side of the base parts 32*a* and 32*b* there are respectively end pieces, which are adapted to the end piece 11 of the base plate 8 and rest with a form fit on the surface of the base plate 8. The radius 33 is adapted exactly to the radius of the flank of the bead 26. By virtue of the exact adaptation of the base parts 32*a* and 32*b* of the side walls 29 and 30 to the base plate 8, uniform adhesive joints are obtained, permitting a particularly durable adhesive bond.

FIG. 5 shows a partial section through a second embodiment of a moving blade 5 of a compressor impeller 1. This embodiment differs from the embodiment according to FIG. 4 in that the approximately radially running portion of the side walls 29 and 30 is convex to some extent. This shaping achieves the effect that, under mechanical loading of the moving blades 5, the stresses between the base parts 32*a* and 32*b* of the side walls 29 and 30 and of the base plate 8 are distinctly reduced, therefore the moving blades 5 of such a design are particularly resistant to high centrifugal forces. A compressor impeller 1 equipped with moving blades 5 of such a design is suitable for particularly high circumferential speeds.

On the exit side, the hub 2 has a collar 12, against which the exit-side end 13 of the moving blade 5 butts. The end 13 is formed from the base plate 8, covered by the base parts 32*a* and 32*b*. At this point, the width of the collar 12 is equal to the thickness of this exit-side end 13 of the moving blade 5, with the result that no projecting edge disturbs the flow of compressed medium flowing out from the compressor impeller 1. The underside of the base plate 8 is adhesively bonded or welded to the surface 9 of the hub 2. The base plates 8 are covered by the base parts 32*a* and 32*b* such that, on the finished compressor impeller 1, the entire surface 9 is covered. In the embodiment of the compressor impeller 1 shown here, after the adhesive bonding and during curing of the adhesive, a bandage 14 is additionally applied on the entry side such that the end piece 11 of each base plate 8 is pressed together with the end pieces of the base parts 32*a* and 32*b* against the offset 10 of the hub 2. The bandage 14 is wound from a prefabricated plastic strip reinforced with continuous fibers. Suitable in particular as plastic in this case are temperature-resistant thermoplastics which are reinforced with carbon fibers. The bandage 14 was wound such that the carbon fibers lie in the circumferential direction, which results in particularly high strength of the bandage 14 in this direction, whereby the base plates 8 and the base parts 32*a* and 32*b* are held securely even at comparatively high rotational speeds of the compressor impeller 1. During the winding, the thermoplastic material of the strip is briefly heated and fused with the layer of the strip respectively applied previously. The bandage 14 is, accordingly, produced using the same process as the hub 2. After the winding, the surface 15 of the bandage 14 is machined in order to achieve an aerodynamic shape of the bandage 14.

Figure 1A:
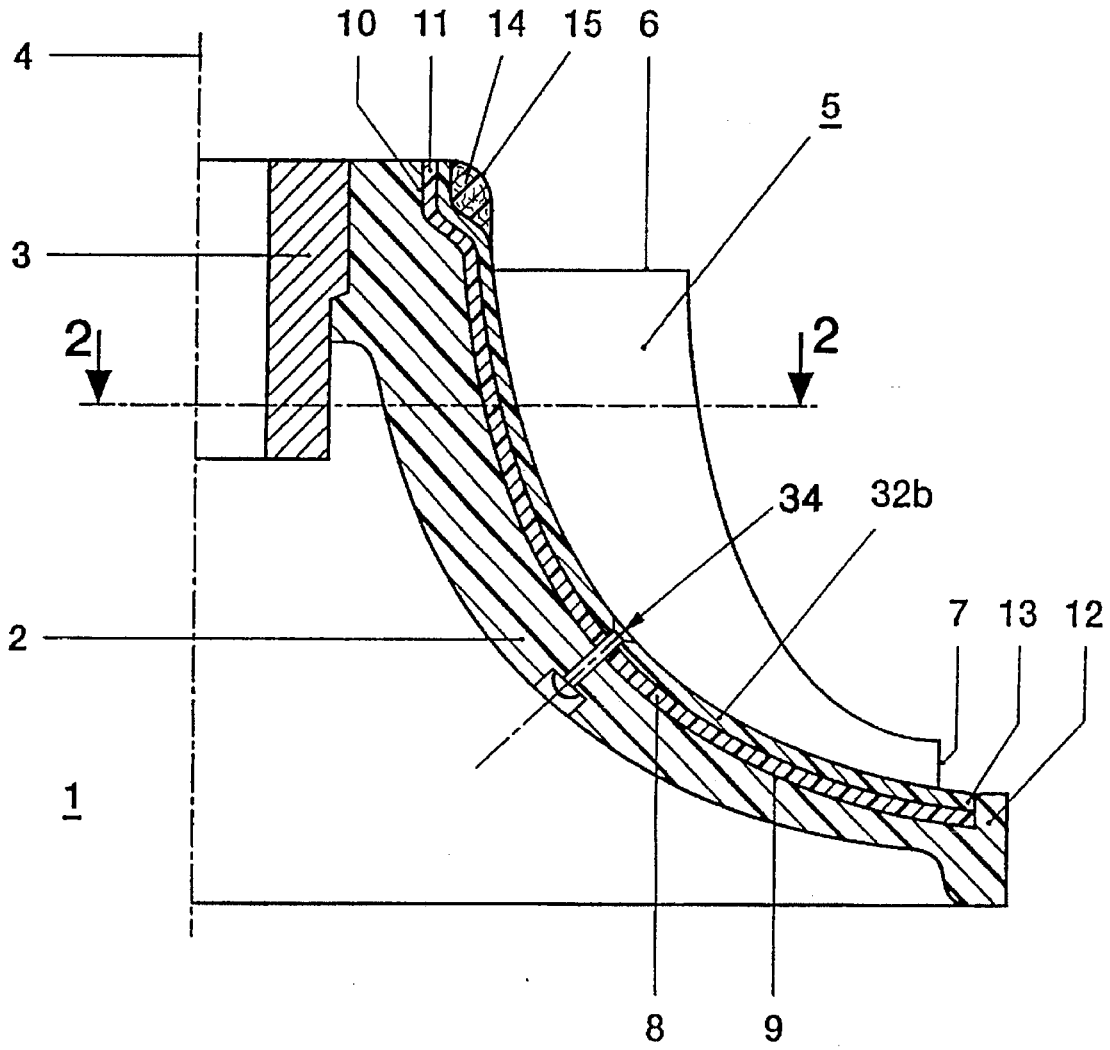
FIG. 1*a* shows an embodiment of the compressor impeller of FIG. 1 with a rivet fastening the base parts and base plate to the hub.

In the case of the compressor impeller 1 according to FIG. 1, the moving blades 5 are held by the adhesive bonding or by the welding, the bandage 14 and the collar 12. This fastening is entirely sufficient up to comparatively high rotational speeds of the compressor impeller 1. If, however, still higher speeds are required, the moving blades 5 are additionally riveted to the hub 2 by means of metal rivets, as shown in FIG. 1*a*, the base parts 32*a* and 32*b* together with the base plates 8 are fastened by rivets 34 to the hub 2. During riveting, it is ensured that the rivet heads do not disturb the flow of the medium in the flow ducts, since this would result in losses in efficiency.

Figure 2:
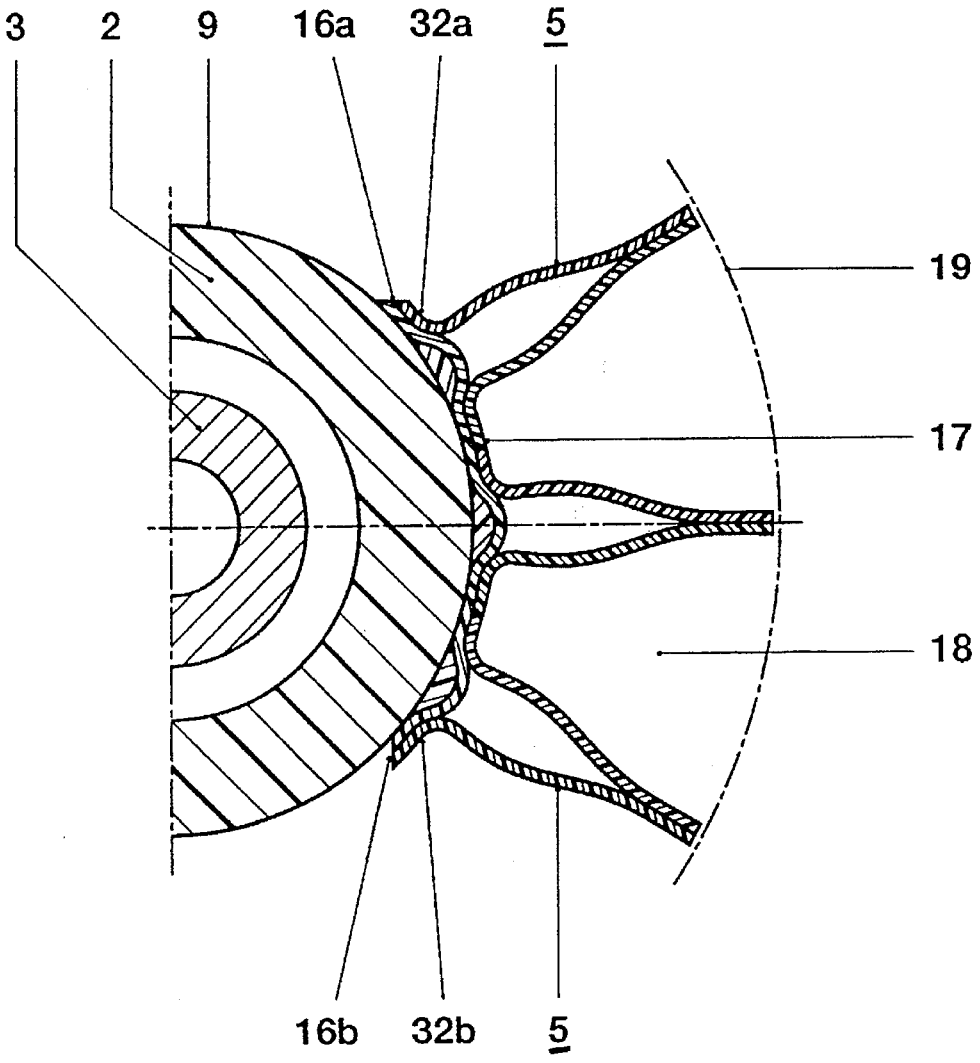
FIG. 2 shows a second partial section through the first embodiment of the compressor impeller.

FIG. 2 shows a schematically represented partial section through the compressor impeller along the lines 2—2 in FIG. 1. The moving blades 5, assembled from a plurality of components, have in the marginal region, where they touch the neighbouring moving blades 5, bevels 16*a*, 16*b*, which allow the margins of the moving blades 5 to be pushed one over the other and to be adhesively bonded effectively, whereby an uninterrupted surface 17 of the side of the flow duct 18 toward the axis 4 is achieved. The dashed line 19 indicates the compressor housing, which closes off outwardly the flow duct 18 bounded laterally by the moving blades 5.

Figure 3:
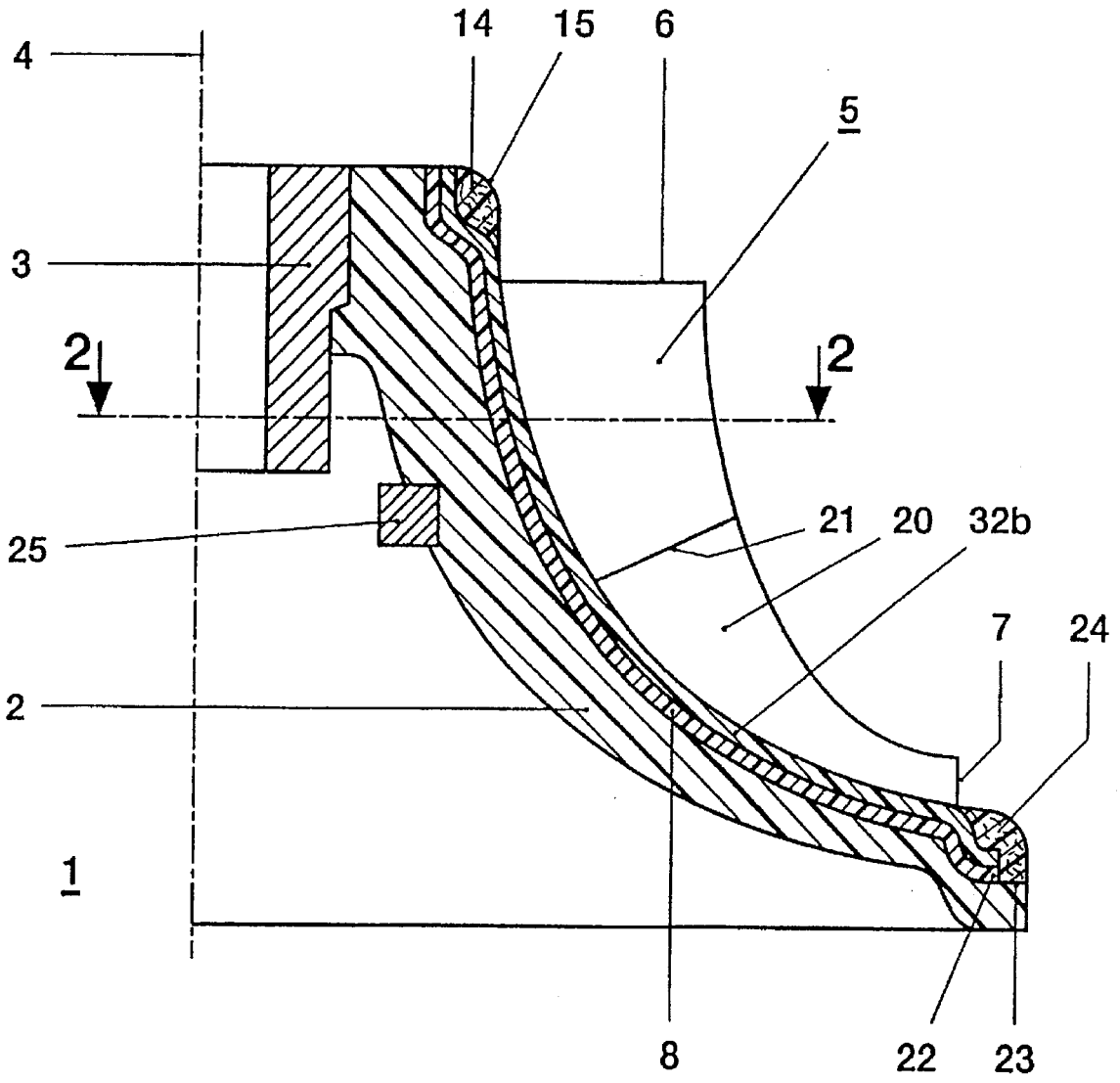
FIG. 3 shows a partial section through a compressor with a second embodiment of a compressor impeller.

FIG. 3 shows a partial section through a second embodiment of a compressor impeller. This embodiment differs from that according to FIG. 1 in that in the interspace between two moving blades 5 there is respectively provided a further moving blade 20, which has an entry edge 21 which is arranged downstream of the entry edge 6 of the moving blades 5. Each flow duct is divided downstream by the moving blade 20 into two flow ducts. The moving blade 20 has an exit edge, which is arranged in the same plane as the exit edge 7 of the moving blades 5. The moving blades 20 are designed in a manner corresponding to the moving blades 5. The moving blades 20 are likewise provided with a base plate to which the corresponding base parts have been applied. This base plate and the base parts connected to it fit exactly into recesses of the base parts 32*a* and 32*b* of the moving blades 5, the moving blades 20 being pushed respectively with a form fit under the moving blades 5. In addition to their adhesive bonding or welding, the moving blades 5 hold the moving blades 20 by means of a dovetail-like toothing. The moving blades 20 are, accordingly, fastened on the hub 2 similarly to the moving blades 5. In this configuration, like the base parts of the moving blades 20, the base parts 32*a* and 32*b* of the moving blades 5 have on the downstream side respectively formed-on end pieces, which are adapted to the exit-side end piece 22 of the base plate 8 and rest with a form fit on the surface of the base plate 8. The end piece 22 rests with a form fit on an offset 23 of the hub 2. In the embodiment of the compressor impeller 1 shown here in FIG. 3, after the adhesive bonding or welding of the moving blades 5 and 20 and after the curing of the adhesive, a bandage 24 is applied in addition to the bandage 14 such that the end pieces 22 of each of the moving blades 5 and each of the moving blades 20 are pressed together with the end pieces of the respective base parts against the offset 23 of the hub 2. Like the bandage 14, the bandage 24 is wound from a prefabricated plastic strip reinforced with continuous fibers and correspondingly welded. The surface of the bandage 24 is subsequently likewise aerodynamically designed.

The compressor impeller 1 according to FIG. 3 additionally has a balancing ring 25, which was embedded into the hub 2 during winding. The balancing ring 25 is produced from metal. During balancing of the finished compressor impeller 1, material is removed from this balancing ring 25 in order to eliminate existing unbalances. It is also possible to make the sleeve 3 with a greater mass and to perform the necessary material removal on the latter, thus allowing the balancing ring 25 to be spared.

For the connection of the side walls 29 and 30 to the base plate 8 and the covering of the entry edge 6 with respect to a moving blade 5 and for the connection of the moving blades 5 to the hub 2, an adhesive based on a phenolic resin is provided; the adhesive HT 424 of the American Cyanamid Company, 1300 Revolution Street, Havre de Grace, Md. 21087, has proved to be particularly suitable here. Furthermore, the adhesive based on a modified condensation polyimide of the same manufacturer with the designation FM 36 is also well suited for the assembly described here. Apart from adhesion, a welding operation with the aid of a laser or a combination of the two processes is conceivable for the connection of the parts of the moving blades 5. The moving blades 20 are assembled in the same manner.

The strip for producing the hub 2 and the bandages 14 and 24 has a matrix comprising a thermoplastic. Polyphenylene sulfide has proved to be particularly suitable as the thermoplastic, and good results have also been achieved with polyether ether ketone. The matrix comprising polyphenylene sulfide was reinforced with approximately 53% by volume of carbon fibers. The cross section of this strip was 5 mm×0.158 mm. The resulting modulus of elasticity of the strip was 114 GPa. The working temperature was, in this case, about 220° C. The matrix comprising polyether ether ketone was reinforced with 61% by volume of carbon fibers. The cross section of this strip was 5 mm×0.125 mm. The resulting modulus of elasticity of the strip was 134,000 MPa. The working temperature was, in this case, about 280° C.

Used as material for producing the component parts of the moving blades 5, 20 is a thermoplastic material which is reinforced with carbon fibers in the form of continuous fibers. This material is supplied in the form of uniformly thick sheets. A matrix comprising polyether ether ketone with 61% by volume of carbon fibers has proved to be particularly suitable. These sheets are placed in molds and brought into the definitive shape by thermal exposure using one of the known processes, it being ensured that the continuous fibers are already oriented in the direction of the principal dynamic loading of the moving blades 5, 20. The component parts prefabricated in this way, the side walls 29 and 30 and the base plate 8, of the moving blades 5, 20 are then assembled, as already described, in an assembly fixture to form the finished moving blade 5 or 20.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A compressor having a compressor impeller comprising a hub of plastic material, a plurality of blades mounted to the hub, a shaft which is connected to the hub and extends along an axis, and a housing which surrounds the compressor impeller, wherein the hub is formed from a thermoplastic material reinforced with continuous fibers, and the blades are prefabricated separately from a thermoplastic material reinforced with continuous fibers and are each shaped with a base conforming with a surface shape of the hub.

2. The compressor as claimed in claim 1, wherein the hub is formed from layers of material wound on a corresponding fixture, wherein during winding the thermoplastic material is heated sufficient for fusing with an underlying layer.

3. The compressor as claimed in claim 2, wherein the hub is formed from a prefabricated, carbon fiber reinforced thermoplastic strip.

4. The compressor as claimed in claim 3, wherein a matrix of the thermoplastic strip is formed from polyphenylene sulfide.

5. The compressor as claimed in claim 3, wherein a matrix of the thermoplastic strip is formed from polyether ether ketone.

6. The compressor as claimed in claim 1, wherein the blades are assembled from at least two preshaped individual parts.

7. The compressor as claimed in claim 1, wherein the blades are assembled from individual preshaped parts by one of an adhesive bonding and welding operation, and the blades are mounted to the hub by one of an adhesive bonding and welding operation.

8. The compressor as claimed in claim 7, wherein the blades base mountings are reinforced by at least one bandage comprising a prefabricated, carbon fiber strip wound on the hub, the strip bandage being formed from a thermoplastic material, wherein during winding the strip is heated sufficient for fusing with an underlying layer of the strip.

9. The compressor as claimed in claim 1, wherein the hub is shrink-fitted onto a sleeve of metal, the sleeve being configured for receiving the shaft.

10. The compressor as claimed in claim 1, wherein the blades are mounted to the hub by rivets.

* * * * *